US008324827B2

(12) United States Patent
Wu

(10) Patent No.: US 8,324,827 B2
(45) Date of Patent: Dec. 4, 2012

(54) UNIVERSAL DIMMING METHOD AND SYSTEM

(75) Inventor: Mingliang Wu, Schaumburg, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 292 days.

(21) Appl. No.: 12/664,720

(22) PCT Filed: Jul. 1, 2008

(86) PCT No.: PCT/IB2008/052647

§ 371 (c)(1),
(2), (4) Date: Dec. 15, 2009

(87) PCT Pub. No.: WO2009/013656

PCT Pub. Date: Jan. 29, 2009

(65) Prior Publication Data

US 2010/0181935 A1 Jul. 22, 2010

Related U.S. Application Data

(60) Provisional application No. 60/948,222, filed on Jul. 6, 2007.

(51) Int. Cl.
*H05B 37/02* (2006.01)

(52) U.S. Cl. ..... 315/291; 315/224; 315/307

(58) Field of Classification Search ..... 315/307, 315/291, 209, 308, 224

See application file for complete search history.

(56) References Cited

U.S. PATENT DOCUMENTS

| | | | | |
|---|---|---|---|---|
| 5,962,992 | A * | 10/1999 | Huang et al. | 315/312 |
| 6,229,271 | B1 | 5/2001 | Liu | |
| 6,486,616 | B1 * | 11/2002 | Liu et al. | 315/291 |
| 7,042,170 | B2 * | 5/2006 | Vakil et al. | 315/291 |
| 2002/0140373 | A1 | 10/2002 | Ribarich et al. | |
| 2005/0179404 | A1 * | 8/2005 | Veskovic et al. | 315/291 |
| 2008/0252233 | A1 * | 10/2008 | Wu | 315/291 |

FOREIGN PATENT DOCUMENTS

| | | | |
|---|---|---|---|
| EP | 1128711 | A2 | 8/2001 |
| WO | 2006006085 | A1 | 1/2006 |
| WO | 2006120641 | A2 | 11/2006 |

* cited by examiner

*Primary Examiner* — Jacob Y Choi
*Assistant Examiner* — Henry Luong
(74) *Attorney, Agent, or Firm* — Kenneth D. Springer; Mark L. Beloborodov

(57) ABSTRACT

A universal line voltage dimming method and system, with a control circuit for an electronic ballast operable to receive ballast input power and an outboard dedicated dimming signal including a power sensing circuit (27) generating a sensed power signal (52) in response to the ballast input power (20); an on-time converter (50) generating an on-time signal (54) in response to the sensed power signal (52); a dedicated dimming interface (122) operable to generate a dedicated dimming signal (124) in response to the outboard dedicated dimming signal (120); and a microprocessor (56) operable to generate a dimming control signal (58) in response to at least one of the on-time signal (54) and the dedicated dimming signal (120). The on-time signal (54) determines the dimming control signal (58) when mains power is phase cut power.

21 Claims, 7 Drawing Sheets

UNIVERSAL DIMMING METHOD AND SYSTEM

This invention relates generally to lamp dimming control, and more specifically to a method and system for lamp dimming with universal dimming systems.

Electronic ballasts for fluorescent lamps have become sophisticated and are widely used in a variety of applications. One application that has presented problems is dimmable electronic ballasts. Two different dimming approaches have been pursued: use of a dimming switch in line with the mains power to provide phase control of mains power into the electronic ballast, or use of a dedicated dimming switch to provide a dedicated dimming signal that controls switching of power to the lamp.

In-line dimming switches, such as triac dimmers, generate a ballast input power with reduced on-time, i.e., the time in which the chopped ballast input power is non-zero. The mains power briefly crosses zero power between positive and negative, but the in-line dimming switch holds the zero power longer to limit power to a load. Reducing the on-time reduces the light level of the lamp.

Dedicated dimming switches, such as 0-10V dimmers, pulse width modulation (PWM) dimmers, or Digital Addressable Lighting Interface (DALI) dimmers, provide a dedicated dimming signal directly to the electronic ballast by wire or wirelessly. The dedicated dimming signal is processed to control the switching of the resonant tank that provides power to the lamp, which controls the light level of the lamp.

Unfortunately, present electronic ballasts work with either in-line dimming switches or dedicated dimming switches, but not with both. This causes additional complication and expense in designing and installing electronic ballast lighting systems. The electronic ballast supplier must stock electronic ballasts for use with both in-line and dedicated dimming switches to meet customers' needs, increasing the cost of inventory. The installer must assure that they have the proper electronic ballasts for a particular job, since the two types are not interchangeable.

It would be desirable to provide a universal line voltage dimming method and system that overcomes the above disadvantages.

One aspect of the invention provides a control circuit for an electronic ballast operable to receive ballast input power and an outboard dedicated dimming signal including a power sensing circuit generating a sensed power signal in response to the ballast input power; an on-time converter generating an on-time signal in response to the sensed power signal; a dedicated dimming interface operable to generate a dedicated dimming signal in response to the outboard dedicated dimming signal; and a microprocessor operable to generate a dimming control signal in response to at least one of the on-time signal and the dedicated dimming signal. The on-time signal determines the dimming control signal when mains power is phase cut power.

Another aspect of the invention provides a lamp control method for an electronic ballast including sensing ballast input power; determining whether the ballast input power is phase cut power; implementing in-line dimmer control when the ballast input power is phase cut power; determining whether a first dedicated dimmer is present when the ballast input power is not phase cut power; and implementing first dedicated dimmer control when the first dedicated dimmer is present.

Another aspect of the invention provides a lamp control system including means for sensing ballast input power; means for determining whether the ballast input power is phase cut power; means for implementing in-line dimmer control when the ballast input power is phase cut power; means for determining whether a first dedicated dimmer is present when the ballast input power is not phase cut power; and means for implementing first dedicated dimmer control when the first dedicated dimmer is present.

The foregoing and other features and advantages of the invention will become further apparent from the following detailed description of the presently preferred embodiment, read in conjunction with the accompanying drawings. The detailed description and drawings are merely illustrative of the invention rather than limiting, the scope of the invention being defined by the appended claims and equivalents thereof.

Figure 1:
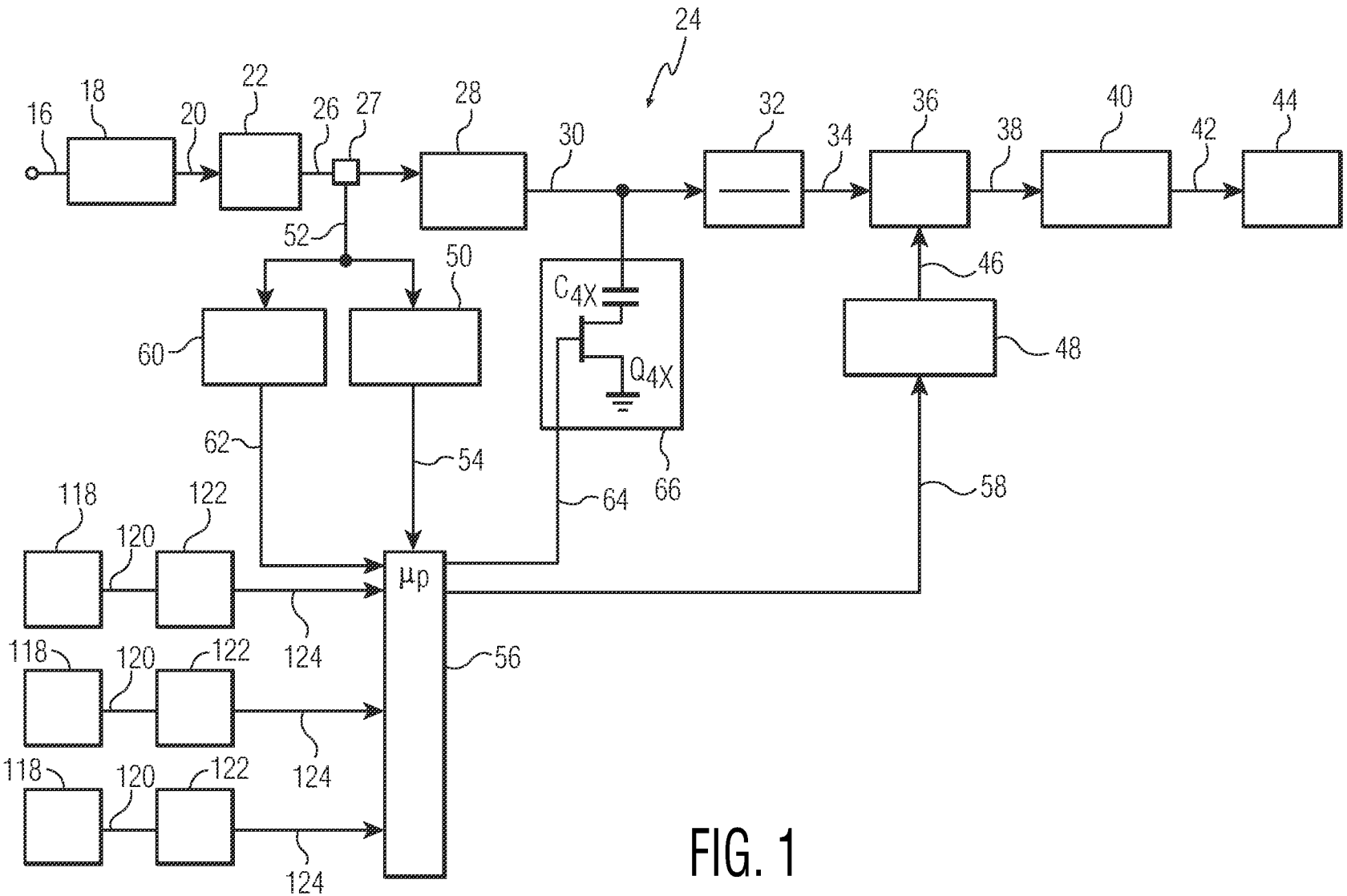
FIG. 1 is a block diagram of a lighting system with a universal dimming electronic ballast made in accordance with the present invention.

FIG. 1 is a block diagram of a lighting system with a universal dimming electronic ballast made in accordance with the present invention. The electronic ballast can be used with an in-line dimmer providing phase cut power from mains power or a dedicated dimmer, such as a 0-10V dimmer, PWM dimmer, or DALI dimmer. An in-line dimmer can be used with a dedicated dimmer, with the in-line dimmer acting as the primary dimmer and the dedicated dimmer acting as a secondary dimmer. When an in-line dimmer is used, the electronic ballast adapts to any ballast input power provided by an in-line dimmer to produce the lamp dimming desired, because the wave form of the power to the lamp is unaffected by the line voltage. A line voltage detector detects line voltage and adjusts boost circuit capacitance through a capacitance selection circuit to maintain electronic ballast operating stability. Those skilled in the art will appreciate that the ballast input power can be supplied by any phase-control device, such as a triac dimmer or the like.

Electronic ballast 24 can be operably connected to an in-line dimmer 18 and/or a dedicated dimmer 118 outside of the electronic ballast 24. The in-line dimmer 18 receives mains power 16, such as 120 Volt or 277 Volt power line power, and provides ballast input power 20 to EMI filter 22. The dedicated dimmer 118 provides an outboard dedicated dimming signal 120 to the dedicated dimming interface 122, which provides a dedicated dimming signal 124 to a microprocessor 56. The outboard dedicated dimming signal 120 can conform to a standard dimmer range or protocol, such as a 0-10V dimmer signal, pulse width modulation (PWM) dimmer signal, Digital Addressable Lighting Interface (DALI) dimmer signal, or the like. In this example, a number of dedicated dimmers 118 are operably connected to the electronic ballast 24.

The electronic ballast 24 receives ballast input power 20 at EMI filter 22 and provides lamp power 42 for a lamp 44 from resonant tank 40. The exemplary electronic ballast 24 includes the EMI filter 22 providing filtered power 26 to a DC rectifier 28, which provides rectified power 30 to boost/power factor controller (PFC) 32. The boost/PFC 32 provides DC bus power 34 to switching circuit 36, which provides switched power 38 to resonant tank 40. The switching circuit 36 is responsive to switching control signal 46 from a switching controller 48. The resonant tank 40 provides the lamp power 42 to the lamp 44.

The electronic ballast 24 can include a dimming circuit with an on-time converter 50 receiving a sensed power signal 52 from a power sensing circuit 27 and generating an on-time signal 54. The microprocessor 56 in the dimming circuit receives the on-time signal 54. When the in-line dimmer 18 controls the dimming, the dimming circuit senses the ballast input power, calculates on-time for the sensed ballast input power, and controls lamp dimming in response to the on-time. As defined herein, on-time is the duration for which each positive or negative voltage pulse of the sensed power signal 52 is non-zero. When the dedicated dimmer 118 controls the dimming, the microprocessor 56 senses the dedicated dimming signal 124 and generates a dimming control signal 58, which is provided to the switching controller 48. The switching controller 48 generates a switching control signal 46 in response to the dimming control signal 58. The switching control signal 46 controls the switching of the switching circuit 36 to control lamp dimming through the resonant tank 40.

The dimming of the lamp 44 can be controlled by the in-line dimmer 18 and/or one or more dedicated dimmer 118. In one embodiment, the electronic ballast 24 is operably connected to the in-line dimmer 18 and the dedicated dimmer 118 is omitted. In another embodiment, the electronic ballast 24 is operably connected to one or more dedicated dimmer 118 and the in-line dimmer 18 is omitted. In yet another embodiment, the electronic ballast 24 is operably connected to both the in-line dimmer 18 and one or more dedicated dimmer 118.

Those skilled in the art will appreciate that in alternate embodiments the microprocessor 56 can be conventional circuits, rather than an integrated circuit programmable microprocessor: the functions of the microprocessor 56 can be performed by conventional circuits rather than the programmable microprocessor as desired. The microprocessor 56 receives DC power from a DC power supply (not shown), which can be powered from any suitable location within the electronic ballast 24, such as the DC bus.

The electronic ballast 24 can include a capacitance selection circuit with a line voltage detector 60 receiving the sensed power signal 52 and generating a line voltage signal 62. The microprocessor 56 is responsive to the line voltage signal 62 to generate a capacitance selector signal 64, which is provided to capacitance circuit 66. The capacitance circuit 66 is operably connected to adjust the capacitance to the boost/PFC 32. The capacitance selection circuit implements a lamp control method that senses a ballast input power, determines line voltage for the sensed ballast input power, and adjusts boost/PFC capacitance in response to the line voltage.

Figure 2:
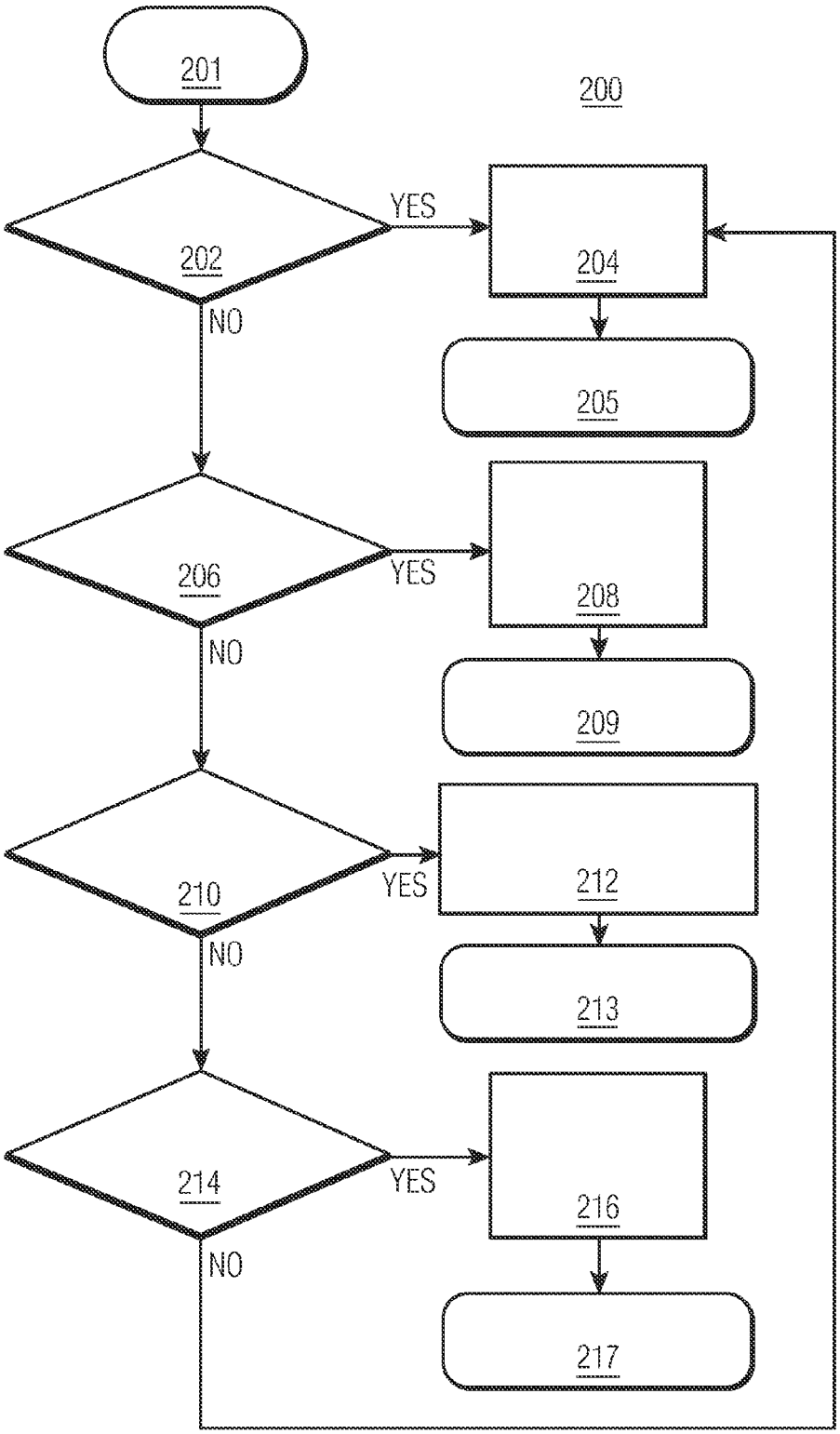
FIG. 2 is a flow chart for a method of controlling a universal dimming electronic ballast made in accordance with the present invention.

FIG. 2 is a flow chart for a method of controlling a universal dimming electronic ballast made in accordance with the present invention. The method 200 starts at 201 and includes determining whether ballast input power is phase cut power 202, implementing in-line dimmer control when the ballast input power is phase cut power 204 and continuing ballast operation with in-line dimmer control 205, determining whether a first dedicated dimmer is present when the ballast input power is not phase cut power 206, implementing first dedicated dimmer control when the first dedicated dimmer is present 208 and continuing ballast operation with first dedicated dimmer control 209, determining whether a second dedicated dimmer is present when the first dedicated dimmer is not present 210, implementing second dedicated dimmer control when the second dedicated dimmer is present 212 and continuing ballast operation with second dedicated dimmer control 213, determining whether a third dedicated dimmer is present when the first dedicated dimmer is not present 214, implementing third dedicated dimmer control when the third dedicated dimmer is present 216 and continuing ballast operation with third dedicated dimmer control 217. When the third dedicated dimmer is not present, in-line dimmer control is implemented 204 and ballast operation continues with in-line dimmer control 205. The in-line dimmer control is full light output control in this case, since no dimmer is detected. Those skilled in the art will appreciate that the fewer than three or more than three dedicated dimmers can be used as desired for a particular application. For example, the electronic ballast can check for phase cut power and the presence of a first dedicated dimmer, and implement in-line dimmer control when neither phase cut power nor a first dedicated dimmer is found. The in-line dimmer control is full light output control in this case, since no dimmer is detected.

Determining whether ballast input power is phase cut power 202 includes determining whether the ballast input power has a phase parameter indicating that the ballast input power is phase cut power. In one embodiment, the phase parameter is phase angle. When the voltage is non-zero above a first predetermined phase angle, such as 20 degrees, the ballast input power is phase cut power indicating that an in-line dimmer, such as an in-line Triac dimmer, is present. When the voltage is non-zero below a second predetermined phase angle, such as 15 degrees, the ballast input power is not phase cut power indicating that no in-line dimmer is present. In another embodiment, the phase parameter is on-time. When the voltage on-time is less than a first predetermined on-time, such as 6.8 milliseconds per half cycle for a 60 Hertz alternating current signal, the ballast input power is phase cut power indicating an in-line dimmer, such as an in-line Triac dimmer, is present. When the voltage on-time is greater than a second predetermined on-time, such as 7.4 milliseconds per half cycle for a 60 Hertz alternating current signal, the ballast input power is not phase cut power indicating that no in-line dimmer is present. Those skilled in the art will appreciate that the first and second predetermined values (phase angle or on-time) can be equal or different depending on the need to avoid inadvertent indication and switching.

Implementing in-line dimmer control when the ballast input power is phase cut power 204 includes actuating the in-line dimmer control program in the microprocessor. In one embodiment, the electronic ballast dimming function is controlled by the in-line dimmer alone and any other dedicated dimmers are ignored. In another embodiment, the electronic ballast dimming function is controlled by the in-line dimmer, with secondary control by at least one of any other dedicated dimmers.

Determining whether a first dedicated dimmer is present when the ballast input power is not phase cut power 206 can include checking a first microprocessor dimmer input to determine whether a dedicated dimmer is operably connected. The microprocessor dimmer input can be set to have a higher voltage, such as 5V, when no dedicated dimmer is connected to the electronic ballast. A high voltage at the microprocessor dimmer input, such as 5V, would indicate that no first dedicated dimmer is present, while a lower voltage, such as a voltage in the range of 0-3V would indicate that a first dedicated dimmer is present.

Implementing first dedicated dimmer control when the first dedicated dimmer is present 208 includes actuating the first dedicated dimmer control program in the microprocessor. The dedicated dimmer control program matches the type of dimmer control, e.g., 0-10V dimmer, PWM dimmer, or DALI dimmer. The electronic ballast dimming function is controlled by the first dedicated dimmer control program and any other dedicated dimmers are ignored. The first dedicated dimmer is selected to have priority over any second or third dedicated dimmers, but is secondary to any in-line dimmer, if there is an in-line dimmer connected. The preference order of first, second, and third dimmers can be selected as desired for a particular application. For example, when the first, second, and third dimmers are a 0-10V dimmer, a PWM dimmer, and a DALI dimmer, respectively, the 0-10V dimmer can be designated the first dedicated dimmer, the PWM dimmer can be designated the second dedicated dimmer, and the DALI dimmer can be designated the third dedicated dimmer. When one or more of the connections for the dedicated dimmers is not in use, the electronic ballast dimming function uses the higher voltage at the microprocessor dimmer input to determine that no dedicated dimmer is connected and ignores the missing dedicated dimmer in the preference order.

Determining whether a second dedicated dimmer is present when the first dedicated dimmer is not present 210, implementing second dedicated dimmer control when the second dedicated dimmer is present 212, determining whether a third dedicated dimmer is present when the first dedicated dimmer is not present 214, and implementing third dedicated dimmer control when the third dedicated dimmer is present 216 can be performed similarly to process employed for the first dedicated dimmer above. When the method 200 does not find an in-line or dedicated dimmer, the method ends 218.

Figure 3:
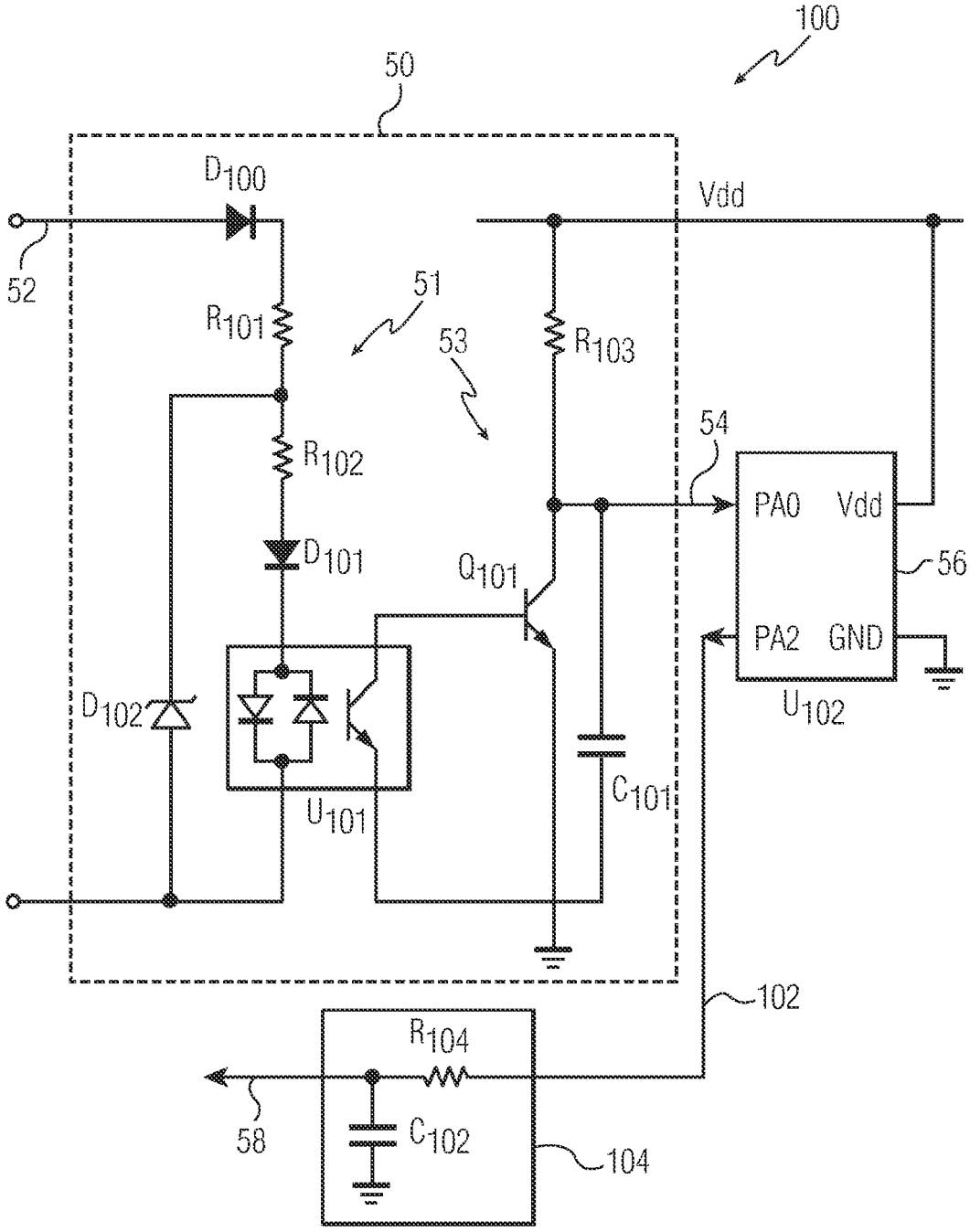
FIGS. 3 & 4A-4C are a schematic diagram and voltage traces, respectively, for a dimming circuit for a universal dimming electronic ballast made in accordance with the present invention.
Figure 4A:
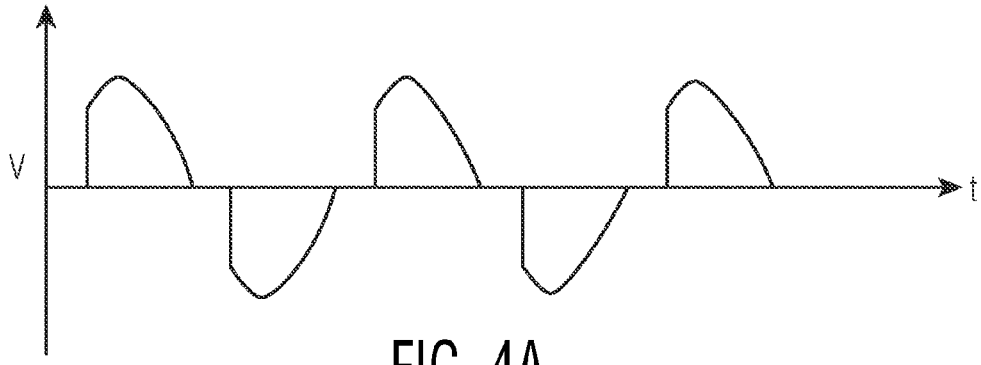
Figure 4B:
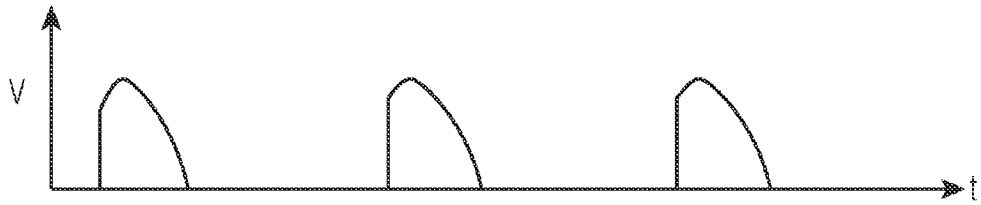
Figure 4C:
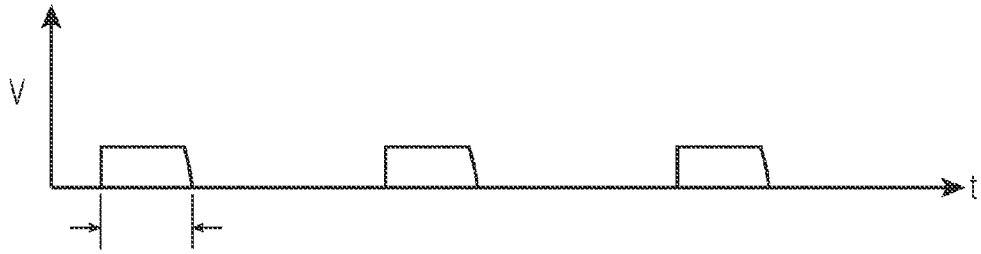

FIG. 3, in which like elements share like reference numbers with FIG. 1, is a schematic diagram of a dimming circuit for a universal line voltage dimming circuit made in accordance with the present invention. FIG. 4 illustrates voltage traces for the dimming circuit of FIG. 3. Referring to FIG. 3, dimming circuit 100 includes on-time converter 50 and microprocessor 56. The on-time converter 50 receives sensed power signal 52 and generates on-time signal 54, which is received by the microprocessor 56. When an in-line dimmer is present and controls the dimming for the electronic ballast, the microprocessor 56 generates pulsed dimming control signal 102, which is converted to the dimming control signal 58 by filter 104.

The on-time converter 50 includes rectifier D100 operably connected to a clipping circuit 51 and a switching circuit 53 operably connected to the clipping circuit 51 through an isolator U101. The clipping circuit 51 includes voltage divider resistors R101 and R102, Zener diode D102 connected between common and the junction of resistors R101 and R102, and optional diode D101. The diode D101 can be omitted when the current through the isolator U101 only flows in one direction, i.e., the isolator U101 receives a DC input. The on-time converter 50 also includes the isolation path diode side of isolator U101 operably connected in series with the diode D101 and the isolation path phototransistor side of isolator U101 operably connected between common and the base of switching transistor Q101. The isolator U101 in this example is an AC sensing phototransistor output optocoupler, although a DC sensing phototransistor output optocoupler can be used in this embodiment because the current through the isolator U101 only flows in one direction. The isolator U101 can be any suitable isolator, such as an optocoupler, an isolation transformer, or the like. The switching circuit 53 includes resistor R103 and capacitor C101 connected in series between Vdd and common, switching transistor Q101 with the collector-emitter path connected in parallel to the capacitor C101, and isolator U101 with the isolation path phototransistor side connected between the base of the switching transistor Q101 and common. The collector of the switching transistor Q101 is connected to terminal PA0 of the microprocessor 56 to provide the on-time signal 54 to the microprocessor 56.

The on-time converter 50 receives the sensed power signal 52. Trace A of FIG. 4 illustrates operation with an in-line dimmer present, so the sensed power signal 52 is phase cut, i.e., the voltage is held at zero for a portion of the cycle to reduce power to the lamp and dim the lamp. The rectifier D100 rectifies the sensed power signal 52, resulting in the rectified ballast input power shown in Trace B of FIG. 4, corresponding to the rectified ballast input power at the location between the rectifier D100 and the resistor R101. In an alternative embodiment, the rectifier can be a full wave rectifier rather than the half wave rectifier D100. The clipping circuit conducts through diode D101 until the voltage at the junction of resistors R101 and R102 exceeds the reverse breakdown voltage of the Zener diode D102, so that the Zener diode D102 then conducts as well and limits the voltage at the junction of resistors R101 and R102. Trace C of FIG. 4 illustrates the voltage of the on-time pulses at the junction of resistors R101 and R102. The on-time is the time between the leading and the lagging edge of each on-time pulse. The on-time pulses switch the current through the diode of the isolator U101, which switches the state of the phototransistor of the isolator U101 and the switching transistor Q101, in turn. The switching transistor Q101 switches voltage from resistor R103 across capacitor C101 to generate the on-time signal 54 at the junction between the resistor R103 and capacitor C101.

In this example, the microprocessor 56 determines that the ballast input power is phase cut power from a phase parameter, such as the on-time or phase angle as described for FIG. 2 above. Referring to FIGS. 3 & 4, the microprocessor 56 analyzes the on-time signal 54 for the on-time and generates the pulsed dimming control signal 102 in accordance with instructions and data stored in the microprocessor 56. The microprocessor 56 detects when the on-time signal 54 goes above a predetermined level, such as 2.5 Volts, to start timing the on-time and when the on-time signal 54 goes below the predetermined level to finish timing the on-time. In an alternate embodiment, the on-time is determined from the slope change of the on-time signal 54 at the leading edge and the lagging edge of the on-time pulse. Those skilled in the art will appreciate that the on-time signal 54 can be inverted as desired, so that the timing the on-time starts and ends when the on-time signal 54 passes beyond the predetermined level, not necessarily exceeding or falling below the predetermined level.

The on-time is converted to the pulsed dimming control signal 102 by calculation or look up table in the microprocessor 56. In one embodiment, the on-time is determined for a single on-time pulse from the on-time signal 54. In an alternate embodiment, the on-time is a moving average on-time determined for a predetermined number of on-time pulses from the on-time signal 54, such as 2, 3, 4, 8, or 16 on-time pulses. In another alternate embodiment, the on-time is a time-weighted average, such as an average assigning greater statistical weight to the more recent on-time pulses. In one embodiment, the conversion from the on-time to the pulsed dimming control signal 102 is a linear function. In an alternate embodiment, the conversion from the on-time to the pulsed dimming control signal 102 is a non-linear function. For example, the conversion can be a logarithmic function to account for the fact that human eyes perceive a higher light level for a dimmed light than the actual light level that would be recorded by a light meter. In one embodiment, the span and offset of the conversion can be selected, e.g., an on-time of about 8.3 milliseconds converts to a full on pulsed dimming control signal 102, an on-time of about 4 milliseconds converts to a middle pulsed dimming control signal 102, and an on-time of about 2.8 milliseconds converts to a minimum pulsed dimming control signal 102.

The microprocessor 56 generates the pulsed dimming control signal 102, which is converted to the dimming control signal 58 by the filter 104. The filter 104 includes resistor R104 and capacitor C102. The span and offset of the dimming control signal 58 can be selected for the desired application, such as about 0.3 to 2.8 Volts corresponding to minimum light output (maximum dimming) and full on light output, respectively. In an alternate embodiment, the microprocessor 56 generates an analog signal as the dimming control signal 58 and the filter 104 can be omitted. A control microprocessor in the switching controller receives the dimming control signal 58 and provides the switching control signal to the switching circuit to set the desired lamp dimming level. In an alternate embodiment, the microprocessor 56 generates a pulsed signal as the dimming control signal 58 and the control microprocessor in the switching controller is responsive to the pulsed signal.

Figure 5:
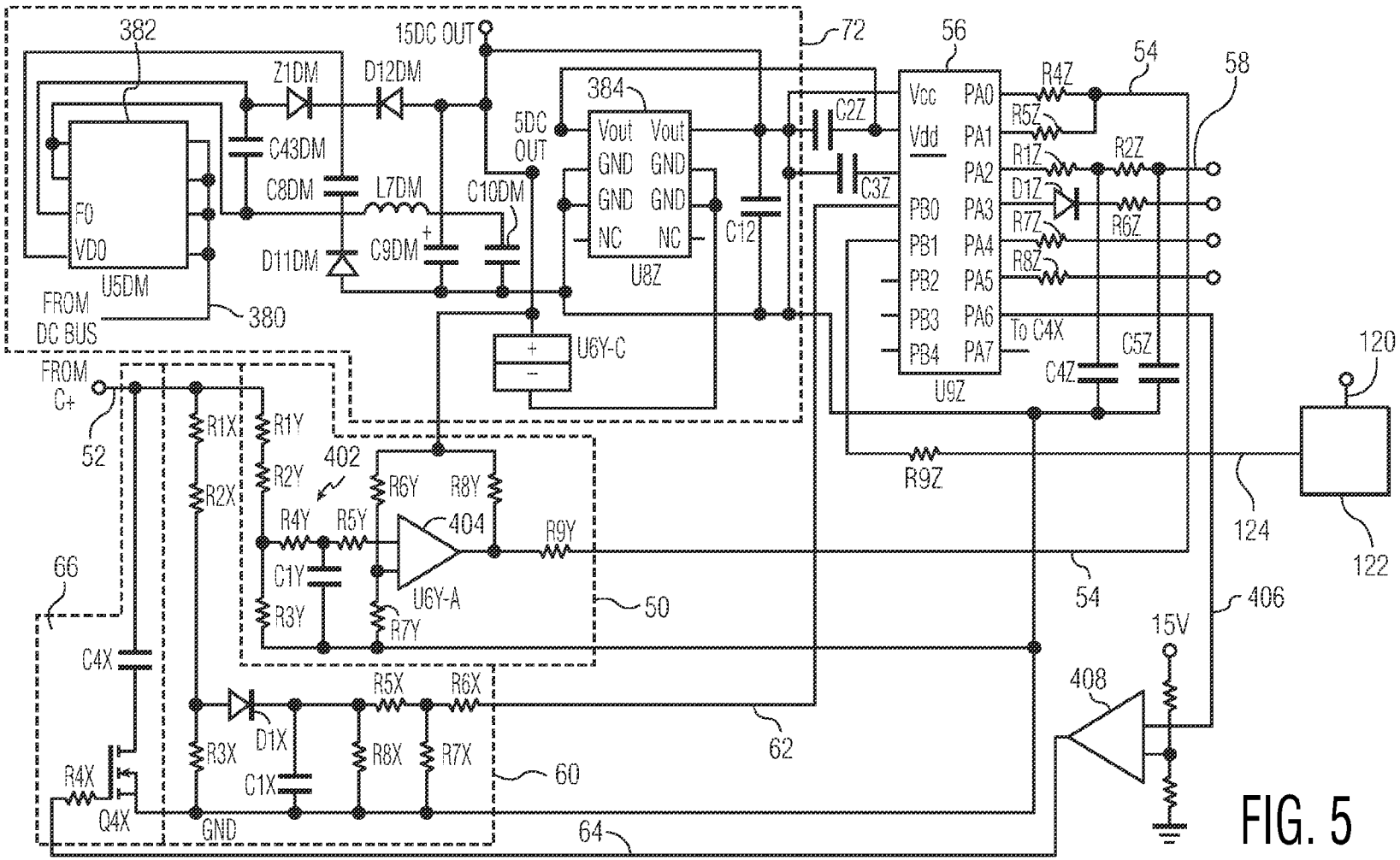
FIG. 5 is a schematic diagram of dimming and capacitance selection circuits for a universal dimming electronic ballast made in accordance with the present invention.
Figure 6A:
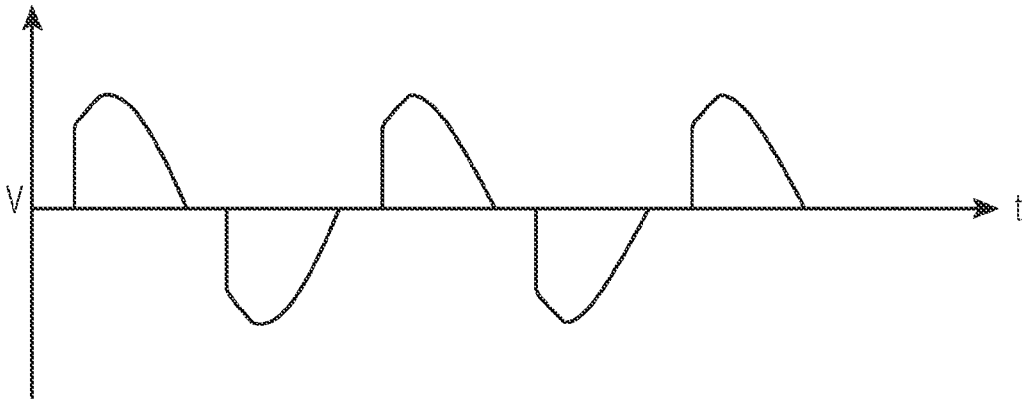
FIGS. 6A-6C are voltage traces for the dimming circuit of FIG. 5.
Figure 6B:
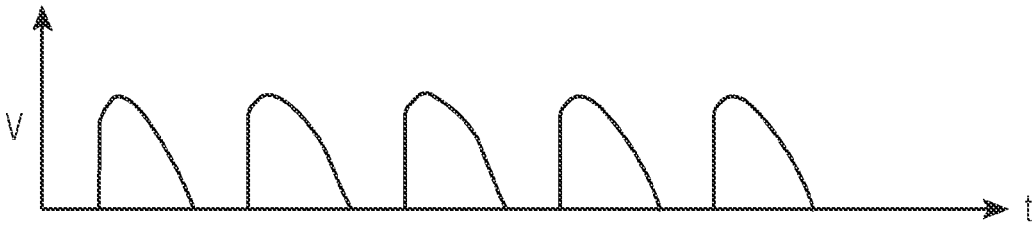
Figure 6C:
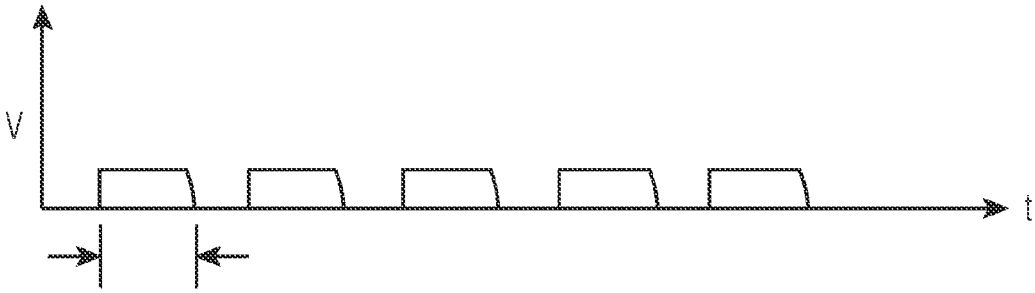

FIG. 5, in which like elements share like reference numbers with FIG. 1, is a schematic diagram of dimming and capacitance selection circuits for a universal dimming electronic ballast made in accordance with the present invention. FIGS. 6A-6C are voltage traces for the dimming circuit of FIG. 5. The dimming circuit provides the dimming control signal responsive to an in-line dimmer and/or a dedicated dimmer external to the electronic ballast. The capacitance selection circuit detects the line voltage and switches capacitance at the boost/PFC. DC power supply 72 receives DC bus power 380 and powers the microprocessor circuit, capacitance selection circuit, and other components as desired. The DC power supply 72 includes 15V power supply 382 and 5V power supply 384.

The dimming circuit includes the on-time converter 50, dedicated dimming interface 122, and microprocessor 56. The on-time converter 50 receives the sensed power signal 52 and generates the on-time signal 54. The dedicated dimming interface 122 receives the outboard dedicated dimming signal 120 and generates the dedicated dimming signal 124. The microprocessor 56 receives the on-time signal 54 and the dedicated dimming signal 124, and determines the dimmer to control the electronic ballast as discussed for FIG. 2 above. The microprocessor 56 generates dimming control signal 58.

The on-time converter 50 includes scaling circuit 402 and comparator 404. The scaling circuit 402 scales and smoothes the sensed power signal 52, which is compared to a predetermined voltage at the comparator 404 to generate the dimming control signal 58. The processing of the dimming control signal 58 to generate the switching control signal 46 is discussed above in conjunction with FIGS. 3 & 4.

The dedicated dimming interface 122 can be connected to the analog or digital inputs of the microprocessor 56 as suitable for the particular dimmer and dedicated dimming interface 122. A number of dedicated dimming interfaces 122 can be connected to the microprocessor 56 as desired for a particular application. The dedicated dimming interfaces 122 match the type of dimmer to which the dedicated dimming interface 122 can be operably connected, such as a 0-10V dimmer, PWM dimmer, or DALI dimmer. When multiple dedicated dimming interfaces 122 are provided, the dedicated dimming interfaces 122 can all be different from each other or some of the dedicated dimming interfaces 122 can be the same. The operation of the dedicated dimming interfaces 122 is described further in conjunction with FIG. 7 below.

Referring to FIG. 5, the capacitance selection circuit includes the line voltage detector 60, microprocessor 56, and capacitance circuit 66. The line voltage detector 60 detects the voltage of the main power feeding the dimmer 18. In this example, the line voltage detector 60 is a line peak detector which provides a line voltage signal 62 proportional to the peak voltage of the sensed power signal 52. The microprocessor 56 detects the level of the line voltage signal 62 and determines whether the main power is high voltage, such as 277 Volts, or a lower voltage, such as 120 Volts. In this example, the microprocessor 56 generates an inverted capacitance selector signal 406, which is inverted at inverter 408 to generate the capacitance selector signal 64. When the main power is high voltage, the microprocessor 56 sets the inverted capacitance selector signal 406 to a first level and when the main power is not high voltage, the microprocessor 56 sets the inverted capacitance selector signal 406 to a second level. When the main power is high voltage as indicated by the capacitance selector signal 64, transistor Q4X in the capacitance circuit 66 is off and no extra capacitance is added to the boost/PFC. When the main power is not high voltage as indicated by the capacitance selector signal 64, transistor Q4X in the capacitance circuit 66 is on and extra capacitor C4X is added to the boost/PFC. Decreasing capacitance increases stability at the higher main power voltage. Using different capacitance values also improves power factor and total harmonic distortion at the different main power voltages.

FIGS. 6A-6C are voltage traces for the dimming circuit of FIG. 5 illustrating operation with an in-line dimmer present, so the ballast input power is phase cut, i.e., the voltage is held at zero for a portion of the cycle to reduce power to the lamp and dim the lamp. In this example, the ballast input power as illustrated in Trace A of FIG. 6 is fully rectified to generate the sensed power signal 52 as illustrated in Trace B of FIG. 6. Trace C of FIG. 6 illustrates the on-time signal 54. The on-time is the time between the leading and the lagging edge of each on-time pulse.

Figure 7A:
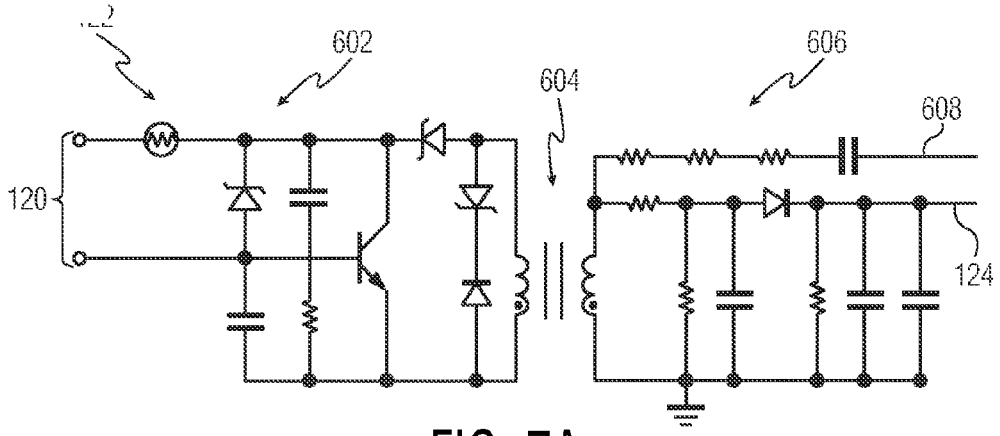
FIGS. 7A-7C are schematic diagrams of dedicated dimmer interface circuits for a universal dimming electronic ballast made in accordance with the present invention.
Figure 7B:
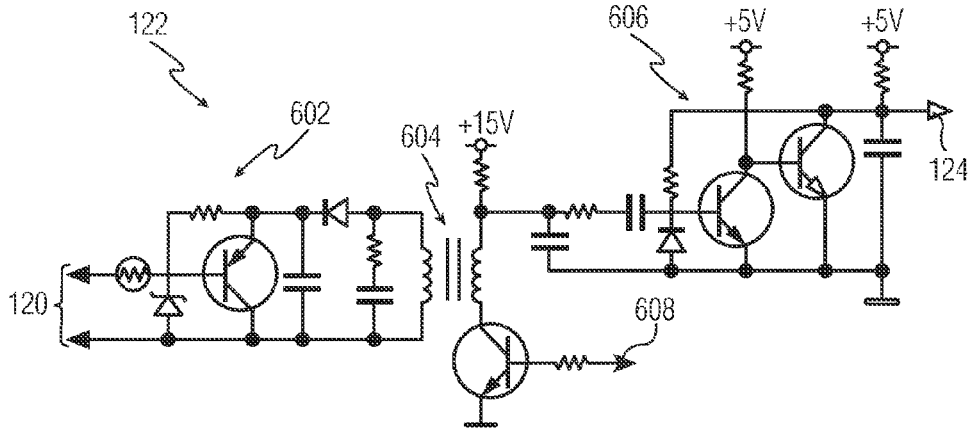
Figure 7C:
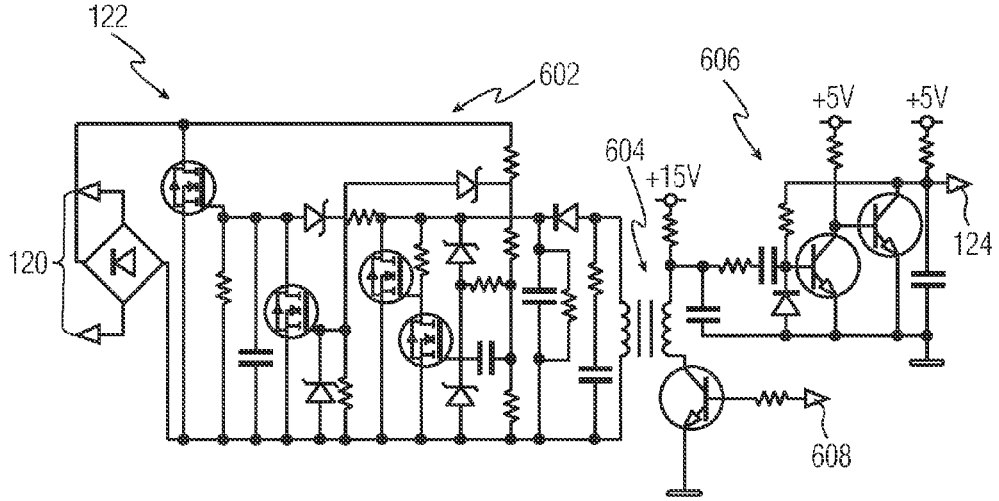

FIGS. 7A-7C, in which like elements share like reference numbers with each other and with FIG. 1, are schematic diagrams of dedicated dimmer interface circuits for a universal dimming electronic ballast made in accordance with the present invention. FIGS. 7A, 7B, & 7C are dedicated dimmer interface circuits for use with 0-10V dimmers, PWM dimmers, and DALI dimmers, respectively.

The dedicated dimmer interface circuit 122 includes an input circuit 602 receiving the outboard dedicated dimming signal 120, an isolator 604, and an output circuit 606 transmitting the dedicated dimming signal 124. In these examples, each output circuit 606 receives a high frequency signal 608 or +5VDC to supply power to the output circuit 606. The high frequency signal 608 can be a square wave at any suitable frequency, such as a frequency in the range of 40 kHz to 80 kHz, or 60 kHz. In one embodiment, the high frequency signal 608 can be obtained from the switching circuit of the electronic ballast. Those skilled in the art will appreciate that the isolator 604 can be omitted from the dedicated dimmer interface circuit 122 when isolation is not required.

Referring to FIG. 7A, the outboard dedicated dimming signal 120 in this example is a 0-10V analog signal. The dedicated dimming signal 124 is a 0-3V analog signal provided to an analog input of the microprocessor.

Referring to FIG. 7B, the outboard dedicated dimming signal 120 in this example is a pulse width modulated (PWM) signal. The dedicated dimming signal 124 is a PWM digital signal provided to a digital input of the microprocessor.

Referring to FIG. 7C, the outboard dedicated dimming signal 120 in this example is a Digital Addressable Lighting Interface (DALI) serial digital signal, conforming to the protocol set out in the fluorescent lamp ballast standard IEC 60929, Annex E. The dedicated dimming signal 124 is a converted 0-5V DALI serial digital signal provided to a digital input of the microprocessor.

Those skilled in the art will appreciate that components can be shared between dedicated dimmer interface circuits when more than one dedicated dimmer interface circuit is used in a single electronic ballast. For example, different windings of a common isolator 604 could be shared between dedicated dimmer interface circuits. In another example, the output circuit 606 after isolator 604 could be shared between dedicated dimmer interface circuits 122 for PWM and DALI interface circuits.

While the embodiments of the invention disclosed herein are presently considered to be preferred, various changes and modifications can be made without departing from the scope of the invention. Those skilled in the art will appreciate that the embodiments described for FIGS. 1, 3, 5, & 7 are exemplary and that alternative circuits can be used as desired for particular applications. The scope of the invention is indicated in the appended claims, and all changes that come within the meaning and range of equivalents are intended to be embraced therein.

The invention claimed is:

1. A control circuit for an electronic ballast operable to receive ballast input power and to receive an outboard dedicated dimming signal comprising:

a power sensing circuit, the power sensing circuit generating a sensed power signal in response to the ballast input power;

an on-time converter, the on-time converter generating an on-time signal in response to the sensed power signal;

a dedicated dimming interface, the dedicated dimming interface being operable to generate a dedicated dimming signal in response to an outboard dedicated dimming signal; and a microprocessor, the microprocessor having a first input connected to receive the on-time signal, and having a second input connected to receive the dedicated dimming signal, the microprocessor being configured to detect whether the ballast input power is phase cut power in response to the on-time signal, and being further configured to detect whether a first dedicated dimmer is present in response to the dedicated dimming signal, and being still further configured to generate a dimming control signal in response to at least one of the on-time signal and the dedicated dimming signal;

wherein the microprocessor controls the dimming control signal in response to the on-time signal when mains power is phase cut power.

2. The circuit of claim 1 wherein the microprocessor controls the dimming control signal in response to the dedicated dimming signal when mains power is not phase cut power.

3. The circuit of claim 1 wherein the dedicated dimming interface is operable to receive the outboard dedicated dimming signal from a dimmer selected from the group consisting of a 0-10V dimmer, a PWM dimmer, and a DALI dimmer.

4. The circuit of claim 1 further comprising a plurality of dedicated dimming interfaces operable to generate a plurality of dedicated dimming signals in response to a plurality of outboard dedicated dimming signals, the plurality of dedicated dimming signals being received at the microprocessor.

5. The circuit of claim 1 further comprising:

a line voltage detector, the line voltage detector generating a line voltage signal in response to the sensed power signal; and a capacitance circuit, the capacitance circuit being responsive to a capacitance selector signal to adjust capacitance of a boost/power factor controller;

wherein the microprocessor is responsive to the line voltage signal and generates the capacitance selector signal.

6. The circuit of claim 1, wherein the microprocessor is configured to control the dimming control signal in response to both the on-time signal and the dedicated dimming signal when the microprocessor detects both that the ballast input power is phase cut power and that the first dedicated dimmer is present.

7. The circuit of claim 1, wherein the microprocessor is configured to detect that the ballast input power is phase cut power when a voltage of the ballast input power is non-zero above a predetermined phase angle, and to detect that the ballast input power is phase cut power when an on-time of the ballast input power is less than a predetermined on-time.

8. A lamp control method for an electronic ballast comprising: sensing ballast input power; determining whether the ballast input power is phase cut power; implementing in-line dimmer control when the ballast input power is phase cut power; determining whether a first dedicated dimmer is present when the ballast input power is not phase cut power, determining whether a second dedicated dimmer is present when the first dedicated dimmer is not present; and implementing second dedicated dimmer control when the second dedicated dimmer is present; implementing first dedicated dimmer control when the first dedicated dimmer is present; determining line voltage for the sensed ballast input power; and adjusting boost/power factor controller capacitance in response to the line voltage.

9. The method of claim 8 further comprising implementing in-line dimmer control when the first dedicated dimmer is not present.

10. The method of claim 8 wherein the determining whether the ballast input power is phase cut power comprises determining whether the ballast input power has a phase parameter indicating that the ballast input power is phase cut power.

11. The method of claim 10 wherein the phase parameter is selected from the group consisting of phase angle and on-time.

12. The method of claim 8 wherein the determining whether the ballast input power is phase cut power comprises determining whether voltage of the ballast input power is non-zero above a predetermined phase angle.

13. The method of claim 8 wherein the determining whether the ballast input power is phase cut power comprises determining whether on-time of the ballast input power is less than a predetermined on-time.

14. A lamp control system comprising: means for receiving and sensing ballast input power; ballast input power detection means for detecting whether the ballast input power is phase cut power; first dedicated dimmer detection means for detecting whether a first dedicated dimmer is present; means for implementing in-line dimmer control of the lamp in response to the ballast input power detection means when the ballast input power is detected to be phase cut power; and means for implementing first dedicated dimmer control of the lamp in response to the first dedicated dimmer detection means when the first dedicated dimmer is detected to be present, wherein the means for implementing in-line dimmer control and the means for implementing first dedicated dimmer control comprise a processor configured to execute both an in-line dimmer control program for performing in-line dimmer control and a first dedicated dimmer control program for performing first dedicated dimmer control when the ballast input power detection means detects that the ballast input power is phase cut power and the first dedicated dimmer detection means detects that the first dedicated dimmer is present.

15. The system of claim 14 further comprising:

second dedicated dimmer detection means for detecting whether a second dedicated dimmer is present when the first dedicated dimmer is not detected to be present; and means for implementing second dedicated dimmer control of the lamp in response to the second dedicated dimmer detection means when the second dedicated dimmer is detected to be present.

16. The system of claim 14 further comprising:

third dedicated dimmer detection means for detecting whether a third dedicated dimmer is present when the first dedicated dimmer is not detected to be present; and means for implementing third dedicated dimmer control of the lamp in response to the third dedicated dimmer detection means when the third dedicated dimmer is detected to be present.

17. The system of claim 14 wherein the ballast input power detection means comprises means for determining whether the ballast input power has a phase parameter indicating that the ballast input power is phase cut power.

18. The system of claim 17 wherein the phase parameter is selected from the group consisting of phase angle and on-time.

19. The system of claim 14 wherein the ballast input power detection means comprises means for determining whether voltage of the ballast input power is non-zero above a predetermined phase angle.

20. The system of claim 14 wherein the ballast input power detection means comprises means for determining whether an on-time of the ballast input power is less than a predetermined on-time.

21. The system of claim 14 further comprising:

means for determining line voltage for the sensed ballast input power; and means for adjusting boost/power factor controller capacitance in response to the line voltage.

* * * * *